US010323539B2

(12) United States Patent
Bewlay et al.

(10) Patent No.: US 10,323,539 B2
(45) Date of Patent: Jun. 18, 2019

(54) SYSTEM AND METHOD FOR CLEANING GAS TURBINE ENGINE COMPONENTS

(71) Applicant: General Electric Company, Schenectady, NY (US)

(72) Inventors: Bernard Patrick Bewlay, Niskayuna, NY (US); Brian Alan Kalb, Montgomery, OH (US); Nicole Jessica Tibbetts, Delanson, NY (US); Ambarish Jayant Kulkarni, Glenville, NY (US); Byron Andrew Pritchard, Jr., Loveland, OH (US)

(73) Assignee: General Electric Company, Schenectady, NY (US)

( * ) Notice: Subject to any disclaimer, the term of this patent is extended or adjusted under 35 U.S.C. 154(b) by 133 days.

(21) Appl. No.: 15/057,179

(22) Filed: Mar. 1, 2016

(65) Prior Publication Data

US 2017/0254218 A1 Sep. 7, 2017

(51) Int. Cl.
*F01D 25/00* (2006.01)
*B24B 31/00* (2006.01)
(Continued)

(52) U.S. Cl.
CPC ..... *F01D 25/002* (2013.01); *B08B 7/02* (2013.01); *B08B 9/00* (2013.01); *B08B 9/08* (2013.01);
(Continued)

(58) Field of Classification Search
CPC ..... B08B 9/08; B24B 31/006; B24C 11/00; B24C 1/00; F01D 25/002; F04D 19/00;
(Continued)

(56) References Cited

U.S. PATENT DOCUMENTS 2,651,887 A * 9/1953 Graham ..... F02B 77/04 134/22.1
2,948,092 A * 8/1960 Fuller ..... F01D 25/002 451/36
(Continued)

FOREIGN PATENT DOCUMENTS

CN 103314186 B 11/2015
DE 2157957 A1 5/1973
(Continued)

OTHER PUBLICATIONS

Extended European Search Report and Opinion issued in connection with corresponding EP Application No. 17158162.2 dated Jul. 4, 2017.
(Continued)

*Primary Examiner* — Marc Carlson
(74) *Attorney, Agent, or Firm* — Dority & Manning, P.A.

(57) ABSTRACT

The present disclosure is directed to a system and method for in-situ (e.g. on-wing) cleaning of gas turbine engine components. The method includes injecting a dry cleaning medium into the gas turbine engine at one or more locations. The dry cleaning medium includes a plurality of abrasive microparticles. Thus, the method also includes circulating the dry cleaning medium through at least a portion of the gas turbine engine such that the abrasive microparticles abrade a surface of the one or more components so as to clean the surface.

20 Claims, 4 Drawing Sheets

(51) Int. Cl.

| | |
|---|---|
| ***B24C 11/00*** | (2006.01) |
| ***B08B 9/08*** | (2006.01) |
| ***B24C 1/00*** | (2006.01) |
| ***B08B 7/02*** | (2006.01) |
| ***B08B 9/00*** | (2006.01) |
| ***B24C 3/32*** | (2006.01) |
| *F04D 19/00* | (2006.01) |

(52) U.S. Cl.
CPC ..... *B24B 31/006* (2013.01); *B24C 1/00* (2013.01); *B24C 3/327* (2013.01); *B24C 11/00* (2013.01); *F04D 19/00* (2013.01); *F05D 2220/32* (2013.01); *F05D 2240/128* (2013.01); *F05D 2240/24* (2013.01); *F05D 2240/30* (2013.01); *F05D 2240/35* (2013.01); *F05D 2260/20* (2013.01)

(58) Field of Classification Search
CPC ..... F05D 2220/32; F05D 2240/128; F05D 2240/24; F05D 2240/30; F05D 2240/35; F05D 2260/20
See application file for complete search history.

(56) References Cited

U.S. PATENT DOCUMENTS 3,084,076 A * 4/1963 Loucks ..... B08B 3/08 134/22.1
3,400,017 A * 9/1968 Huebner, Jr. ..... F01D 25/002 134/22.17
4,548,617 A * 10/1985 Miyatani ..... C09K 3/1409 264/118
4,834,912 A * 5/1989 Hodgens, II ..... B08B 3/02 134/2
5,107,674 A 4/1992 Wibbelsman et al.
5,232,514 A * 8/1993 Van Sciver ..... B24C 11/00 134/26
5,316,587 A 5/1994 Yam et al.
5,758,486 A * 6/1998 Fetescu ..... B08B 7/026 60/779
7,412,741 B2 8/2008 Roney et al.
8,505,201 B2 * 8/2013 DeMichael ..... F01D 5/005 29/402.07
8,820,046 B2 9/2014 Ross et al.
8,834,649 B2 * 9/2014 Gebhardt ..... F01D 25/002 134/115 R
2003/0102011 A1 * 6/2003 Smith ..... B08B 9/057 134/8
2005/0091963 A1 * 5/2005 Li ..... F02K 1/36 60/262
2006/0243308 A1 * 11/2006 Asplund ..... B08B 3/02 134/22.12
2007/0000528 A1 * 1/2007 Asplund ..... B08B 3/02 134/166 R
2010/0043438 A1 * 2/2010 Barber ..... F01D 21/00 60/646
2012/0273012 A1 11/2012 Wilson
2013/0174869 A1 * 7/2013 Rosing ..... B08B 7/0021 134/7
2013/0199040 A1 * 8/2013 Dudeck ..... B23P 6/002 29/889.1
2013/0311060 A1 * 11/2013 Smith ..... F01D 25/002 701/100
2014/0066349 A1 * 3/2014 Hughes ..... F01D 25/002 510/186
2015/0083165 A1 * 3/2015 Moliere ..... F01D 25/002 134/22.14
2015/0159122 A1 * 6/2015 Tibbetts ..... C11D 7/3209 134/22.18
2015/0300263 A1 * 10/2015 Sokolov ..... F02C 7/30 60/772
2016/0024438 A1 * 1/2016 Tibbetts ..... C11D 3/2086 134/3
2017/0191376 A1 * 7/2017 Eriksen ..... B24C 3/327
2017/0204739 A1 7/2017 Rawson et al.

FOREIGN PATENT DOCUMENTS

GB 789 930 A 1/1958
GB 829 921 A 3/1960
GB 829921 A * 3/1960 ..... F01D 25/002

OTHER PUBLICATIONS

Machine Translation of the First Office action and Search issued in connection with corresponding CN Application No. 201710116874.7 dated Oct. 9, 2018.

* cited by examiner

SYSTEM AND METHOD FOR CLEANING GAS TURBINE ENGINE COMPONENTS

FIELD OF THE INVENTION

The present subject matter relates generally to gas turbine engines, and more particularly, to systems and methods for in-situ cleaning of gas turbine engine components using abrasive particles.

BACKGROUND OF THE INVENTION

A gas turbine engine generally includes, in serial flow order, a compressor section, a combustion section, a turbine section and an exhaust section. In operation, air enters an inlet of the compressor section where one or more axial or centrifugal compressors progressively compress the air until it reaches the combustion section. Fuel is mixed with the compressed air and burned within the combustion section to provide combustion gases. The combustion gases are routed from the combustion section through a hot gas path defined within the turbine section and then exhausted from the turbine section via the exhaust section.

In particular configurations, the turbine section includes, in serial flow order, a high pressure (HP) turbine and a low pressure (LP) turbine. The HP turbine and the LP turbine each include various rotatable turbine components such as turbine rotor blades, rotor disks and retainers, and various stationary turbine components such as stator vanes or nozzles, turbine shrouds, and engine frames. The rotatable and stationary turbine components at least partially define the hot gas path through the turbine section. As the combustion gases flow through the hot gas path, thermal energy is transferred from the combustion gases to the rotatable and stationary turbine components.

A typical gas turbine engine includes very fine cooling passages that allow for higher gas temperatures in the combustor and/or the HP or LP turbines. During operation, particularly in environments that contain fine-scale dust (e.g. PM 10), environmental particulate accumulates on engine components and within the cooling passages of the engine. For example, dust (reacted or non-reacted), sand, or similar can build up on the flow path components and on the impingement cooled surfaces during turbine engine operation. In addition, particulate matter entrained in the air that enters the turbine engine and the cooling passages can contain sulphur-containing species that can corrode the components. Such accumulation can lead to reduced cooling effectiveness of the components and/or corrosive reaction with the metals and/or coatings of the engine components. Thus, particulate build-up can lead to premature distress and/or reduced engine life. Additionally, accumulations of environmental contaminants (e.g. dust-reacted and unreacted, sand, etc.) such as these can degrade aerodynamic performance of the high-pressure components and lower fuel efficiency of the engine through changes in airfoil morphology.

Accordingly, the present disclosure is directed to a system and method for cleaning engine components using abrasive particles that addresses the aforementioned issues. More specifically, the present disclosure is directed to a system and method for in-situ cleaning of engine components that utilizes abrasive microparticles that are particularly useful for cleaning internal cooling passages of the gas turbine engine.

BRIEF DESCRIPTION OF THE INVENTION

Aspects and advantages of the invention will be set forth in part in the following description, or may be obvious from the description, or may be learned through practice of the invention.

In one aspect, the present disclosure is directed to a method for in-situ (e.g. on-wing) cleaning one or more components of a gas turbine engine. The method includes injecting a dry cleaning medium into the gas turbine engine at one or more locations. The dry cleaning medium includes a plurality of abrasive microparticles. Thus, the method also includes circulating the dry cleaning medium through at least a portion of the gas turbine engine such that the abrasive microparticles abrade a surface of the one or more components so as to clean the surface. Further, the abrasive microparticles may be subsequently removed from the engine either through standard engine operation cooling airflow and/or via incineration such that the residual ash content meets the requirements for application to a fully assembled gas turbine on-wing.

In another aspect, the present disclosure is directed to a cleaning system for in-situ cleaning of one or more components of a gas turbine engine. The cleaning system includes a dry cleaning medium containing a plurality of abrasive microparticles. Each of the abrasive microparticles has a particle diameter size range of from about 10 microns to about 100 microns. Further, the cleaning system includes a delivery system configured to deliver the cleaning medium at one or more locations of the gas turbine engine so as to clean the one or more components thereof.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
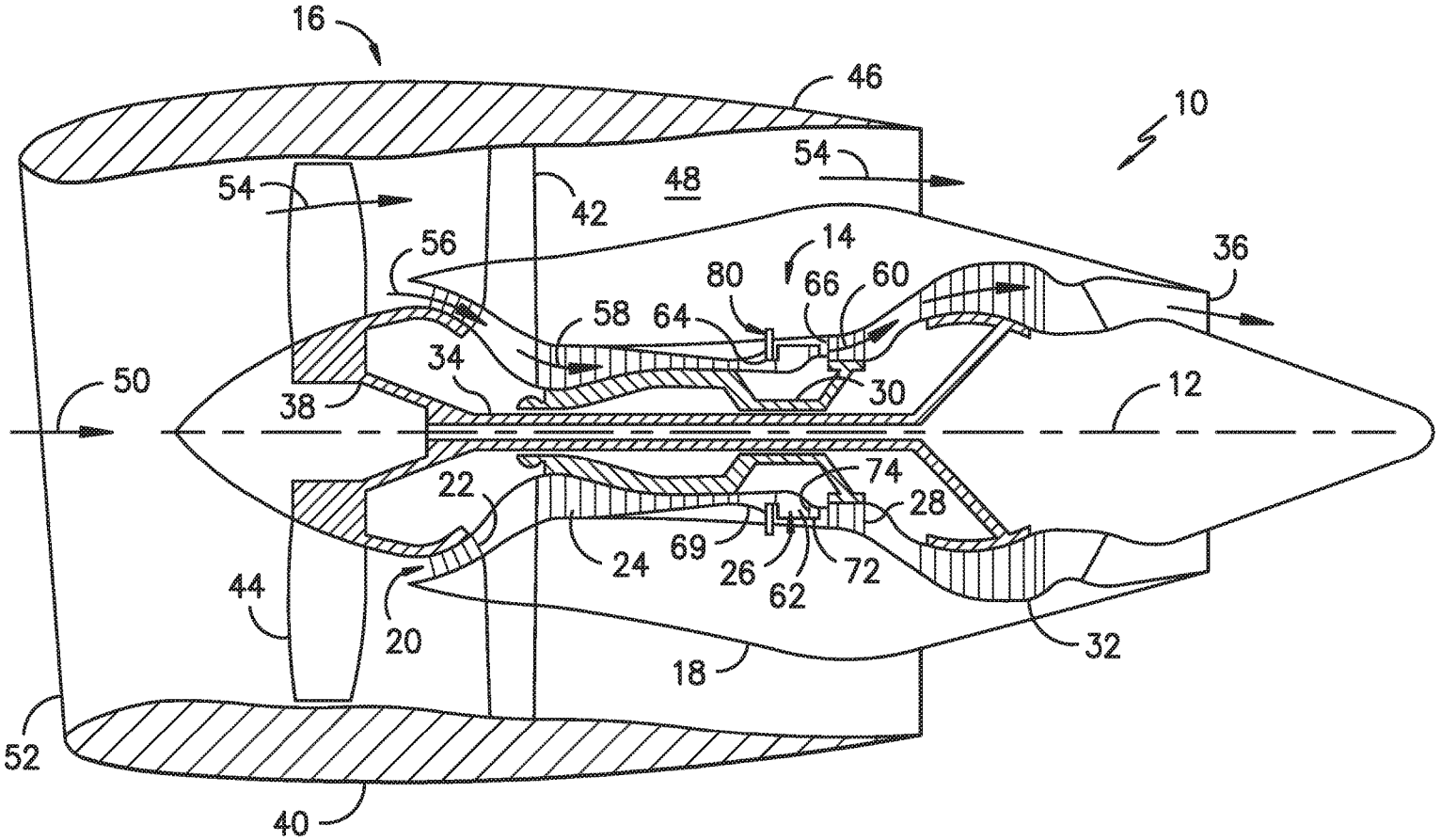
FIG. 1 illustrates a schematic cross-sectional view of one embodiment of a gas turbine engine according to the present disclosure.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Generally, the present disclosure is directed to cleaning systems and methods for in-situ (e.g. on-wing) cleaning one or more components of a gas turbine engine. The method includes injecting a dry cleaning medium into the gas turbine engine at one or more locations, wherein the dry cleaning medium includes a plurality of abrasive microparticles. Further, the abrasive microparticles may be suspended in air, water, and/or water-based detergent. Thus, the method also includes circulating the cleaning medium through at least a portion of the gas turbine engine such that the abrasive microparticles abrade a surface of the one or more components so as to clean the surface.

The present disclosure provides various advantages not present in the prior art. For example, gas turbine engines according to present disclosure can be cleaned on-wing, in-situ, and/or off-site with the engine maintained in the fully assembled condition. Further, the cleaning methods of the present disclosure provide simultaneous mechanical and chemical removal of particulate deposits in cooling passageways of gas turbine engines. In addition, the system and method of the present disclosure improves cleaning effectiveness and has significant implications for engine time on-wing durability. Moreover, the present invention provides an abrasive media cleaning and delivery system and a method for uniform circumferential cleaning of a turbine engine that does not necessarily require a subsequent rinse cycle.

Referring now to the drawings, FIG. 1 illustrates a schematic cross-sectional view of one embodiment of a gas turbine engine 10 (high-bypass type) according to the present disclosure. As shown, the gas turbine engine 10 has an axial longitudinal centerline axis 12 therethrough for reference purposes. Further, as shown, the gas turbine engine 10 preferably includes a core gas turbine engine generally identified by numeral 14 and a fan section 16 positioned upstream thereof. The core engine 14 typically includes a generally tubular outer casing 18 that defines an annular inlet 20. The outer casing 18 further encloses and supports a booster 22 for raising the pressure of the air that enters core engine 14 to a first pressure level. A high pressure, multistage, axial-flow compressor 24 receives pressurized air from the booster 22 and further increases the pressure of the air. The pressurized air flows to a combustor 26, where fuel is injected into the pressurized air stream and ignited to raise the temperature and energy level of the pressurized air. The high energy combustion products flow from the combustor 26 to a first (high pressure) turbine 28 for driving the high pressure compressor 24 through a first (high pressure) drive shaft 30, and then to a second (low pressure) turbine 32 for driving the booster 22 and the fan section 16 through a second (low pressure) drive shaft 34 that is coaxial with the first drive shaft 30. After driving each of the turbines 28 and 32, the combustion products leave the core engine 14 through an exhaust nozzle 36 to provide at least a portion of the jet propulsive thrust of the engine 10.

The fan section 16 includes a rotatable, axial-flow fan rotor 38 that is surrounded by an annular fan casing 40. It will be appreciated that fan casing 40 is supported from the core engine 14 by a plurality of substantially radially-extending, circumferentially-spaced outlet guide vanes 42. In this way, the fan casing 40 encloses the fan rotor 38 and the fan rotor blades 44. The downstream section 46 of the fan casing 40 extends over an outer portion of the core engine 14 to define a secondary, or bypass, airflow conduit 48 that provides additional jet propulsive thrust.

From a flow standpoint, it will be appreciated that an initial airflow, represented by arrow 50, enters the gas turbine engine 10 through an inlet 52 to the fan casing 40. The airflow passes through the fan blades 44 and splits into a first air flow (represented by arrow 54) that moves through the conduit 48 and a second air flow (represented by arrow 56) which enters the booster 22.

The pressure of the second compressed airflow 56 is increased and enters the high pressure compressor 24, as represented by arrow 58. After mixing with fuel and being combusted in the combustor 26, the combustion products 60 exit the combustor 26 and flow through the first turbine 28. The combustion products 60 then flow through the second turbine 32 and exit the exhaust nozzle 36 to provide at least a portion of the thrust for the gas turbine engine 10.

Still referring to FIG. 1, the combustor 26 includes an annular combustion chamber 62 that is coaxial with the longitudinal centerline axis 12, as well as an inlet 64 and an outlet 66. As noted above, the combustor 26 receives an annular stream of pressurized air from a high pressure compressor discharge outlet 69. A portion of this compressor discharge air flows into a mixer (not shown). Fuel is injected from a fuel nozzle 80 to mix with the air and form a fuel-air mixture that is provided to the combustion chamber 62 for combustion. Ignition of the fuel-air mixture is accomplished by a suitable igniter, and the resulting combustion gases 60 flow in an axial direction toward and into an annular, first stage turbine nozzle 72. The nozzle 72 is defined by an annular flow channel that includes a plurality of radially-extending, circumferentially-spaced nozzle vanes 74 that turn the gases so that they flow angularly and impinge upon the first stage turbine blades of the first turbine 28. As shown in FIG. 1, the first turbine 28 preferably rotates the high-pressure compressor 24 via the first drive shaft 30, whereas the low-pressure turbine 32 preferably drives the booster 22 and the fan rotor 38 via the second drive shaft 34.

The combustion chamber 62 is housed within the engine outer casing 18 and fuel is supplied into the combustion chamber 62 by one or more fuel nozzles 80. More specifically, liquid fuel is transported through one or more passageways or conduits within a stem of the fuel nozzle 80.

Figure 2:
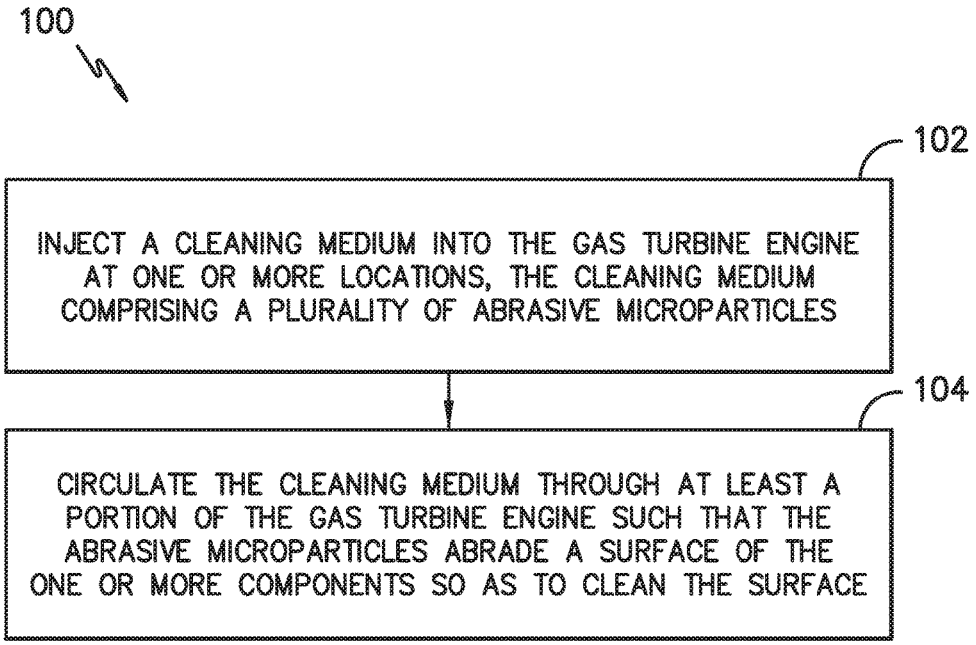
FIG. 2 illustrates a flow diagram of one embodiment of a method for in-situ cleaning of one or more components of a gas turbine engine according to the present disclosure.

Referring now to FIG. 2, a flow diagram of one embodiment of a method 100 for in-situ cleaning one or more components of a gas turbine engine (e.g. such as the gas turbine engine 10 illustrated in FIG. 1) is illustrated. For example, in certain embodiments, the component(s) of the gas turbine engine 10 may include any of the components of the engine 10 as described herein, including but not limited to the compressor 24, the high-pressure turbine 28, the low-pressure turbine 32, the combustor 26, the combustion chamber 62, one or more nozzles 72, 80, one or more blades 44 or vanes 42, the booster 22, a casing 18 of the gas turbine engine 10, cooling passageways of the engine 10, turbine shrouds, or similar.

Thus, as shown at 102, the method 100 may include injecting a dry cleaning medium 84 into the gas turbine engine 10 at one or more locations. More specifically, the step of injecting the cleaning medium into the gas turbine engine 10 may include injecting the cleaning medium 84 into an inlet (e.g. inlet 20, 52 or 64) of the engine 10. Alternatively or in addition, as shown, the step of injecting the cleaning medium 84 into the gas turbine engine 10 may include injecting the cleaning medium 84 into one or more ports 82 of the engine 10. Further, the step of injecting the cleaning medium 84 into the gas turbine engine 10 may include injecting the cleaning medium 84 into an existing baffle plate system (not shown) of the gas turbine engine 10. Further, the cleaning medium 84 may be injected into the engine 10 using any suitable means. More specifically, in certain embodiments, the cleaning medium 84 may be injected into the engine 10 using automatic and/or manual devices configured to pour, funnel, or channel substances into the engine 10.

Figure 3:
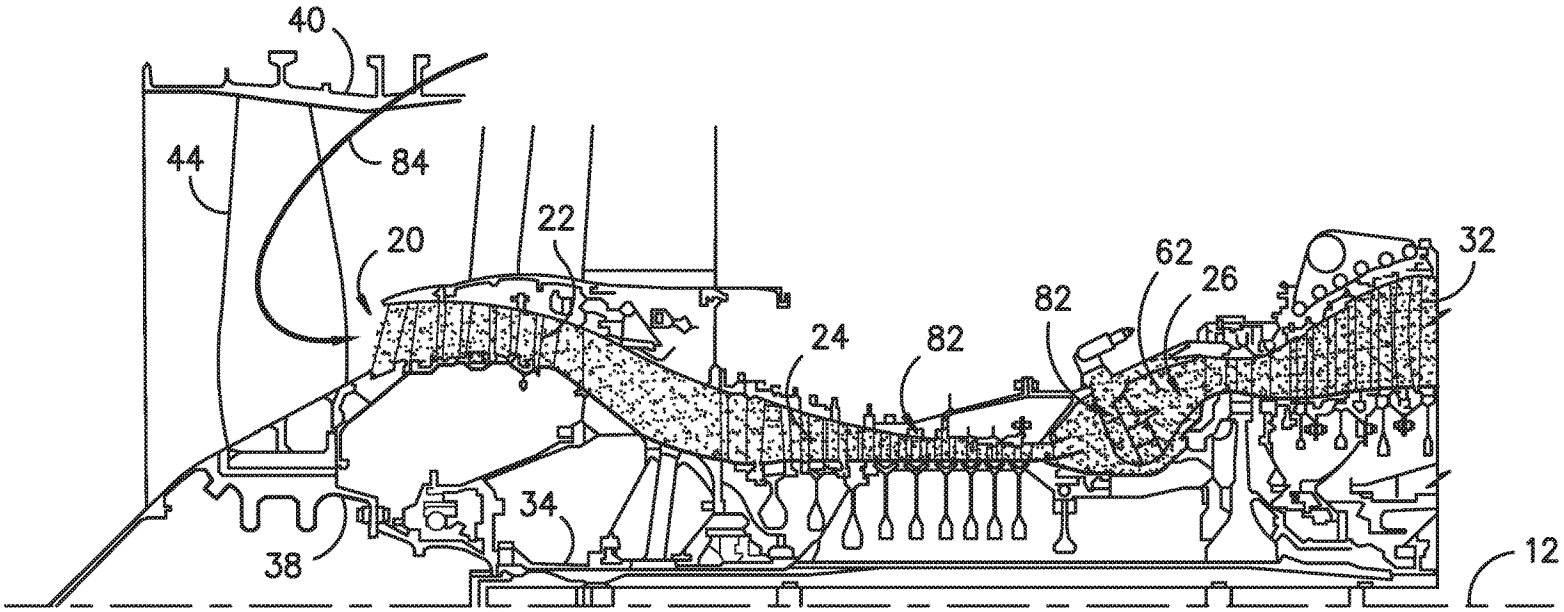
FIG. 3 illustrates a partial, cross-sectional view of one embodiment of a gas turbine engine, particularly illustrating a cleaning medium being injected into the engine at a plurality of locations according to the present disclosure.

For example, referring now to FIG. 3, a partial, cross-sectional view of one embodiment of the gas turbine engine 10 according to the present disclosure is illustrated. As shown, the cleaning medium (as indicated by arrow 84) may be injected into the engine 10 at a plurality of locations. More specifically, as shown, the cleaning medium is injected to the inlet 20 of the engine 10. Further, as shown, the cleaning medium 84 may be injected into one or more ports 82 of the engine 10. For example, as shown, the cleaning medium 84 may be injected into a port 82 of the compressor 24 and/or a port 82 of the combustion chamber 62. Further, the cleaning medium 84 contains a plurality of abrasive microparticles. Thus, the cleaning medium particles are configured to flow through the engine 10 and abrade the surfaces of the engine components so as to clean said surfaces. In addition, in certain embodiments, where organic abrasive microparticles are used, the cleaning medium 84 does not necessarily require a subsequent rinse cycle after cleaning.

As used herein, "microparticles" generally refer to particles having a particle diameter of between about 0.1 microns or micrometers to about 100 microns. In certain embodiments, the plurality of microparticles may have particle diameter of from about 10 microns to about 100 microns. Below 10 microns, the particle momentum may not be sufficient to effectively remove dust in the engine 10 and could potentially accumulate within particular cooling circuits. Further, above 100 microns, the particles may not have sufficient velocity and therefore will not be able to effectively remove dust in the engine 10 and could potentially accumulate within particular cooling circuits. In other words, it is necessary for the particles to be larger than a sticking size and smaller than a critical size than can lead to plugging of the fine cooling circuits. Thus, the preferred particle size for cleaning both the flow path of the components and the cooling circuits of the turbine is typically from about 10 microns and to about 100 microns.

In addition, the cleaning medium 84 of the present disclosure may include any suitable abrasive particles now known or later developed in the art. For example, in one embodiment, the cleaning medium 84 may include organic particles such as nut shells (e.g. walnut shells), fruit pit stones (e.g. plum), and/or any other suitable organic material. The organic material has some cleaning advantages, including but not limited to ease of elimination from the engine 10 after cleaning. In additional embodiments, the cleaning medium 84 may also include non-organic particles such as e.g., alumina, silica (e.g. silicon carbide), diamond, or similar.

In addition, the particles of the cleaning medium 84 may have varying particle sizes. For example, in certain embodiments, the abrasive microparticles may include a first set of microparticles having a median or average particle diameter within a first, smaller micron range and a second set of microparticles having a median particle diameter within a second, larger micron range. More specifically, as used herein, a "micron range" generally encompasses a particle diameter size range measured in micrometers and less than 100 microns. For example, in certain embodiments, the first set of microparticles may have a median particle diameter equal to or less than 20 microns, whereas the second set of microparticles may have a median particle diameter equal to or greater than 20 microns. More specifically, the first micron range may be equal to or less than 10 microns, whereas the second micron range may be equal to or greater than 30 microns, or more preferably equal to or greater than 40 microns. Thus, a median of the second micron range may be larger than a median or average of the first micron range.

Accordingly, as shown at 104 of FIG. 2, the method 100 may also include circulating the cleaning medium 84 through at least a portion of the gas turbine engine 10 such that the plurality of abrasive microparticles clean the one or more components thereof. More specifically, the abrasive microparticles of the cleaning medium 84 can be carried into smaller areas of the engine 10, e.g. into the smaller cooling passageways, which are inaccessible to larger particles.

In additional embodiments, the step of circulating the cleaning medium 84 through at least a portion of the gas turbine engine 10 may include motoring or running the engine 10 during injection of the cleaning medium 84 so as to circulate the particles through the gas turbine engine 10 via airflow. Alternatively, the step of circulating the cleaning medium 84 through at least a portion of the gas turbine engine 10 may include utilizing one or more external pressure sources to provide airflow that circulates the particles through the gas turbine engine 10. For example, in certain embodiments, the external pressure sources 96 (FIG. 4) may include a fan, a blower, or similar.

Figure 4:
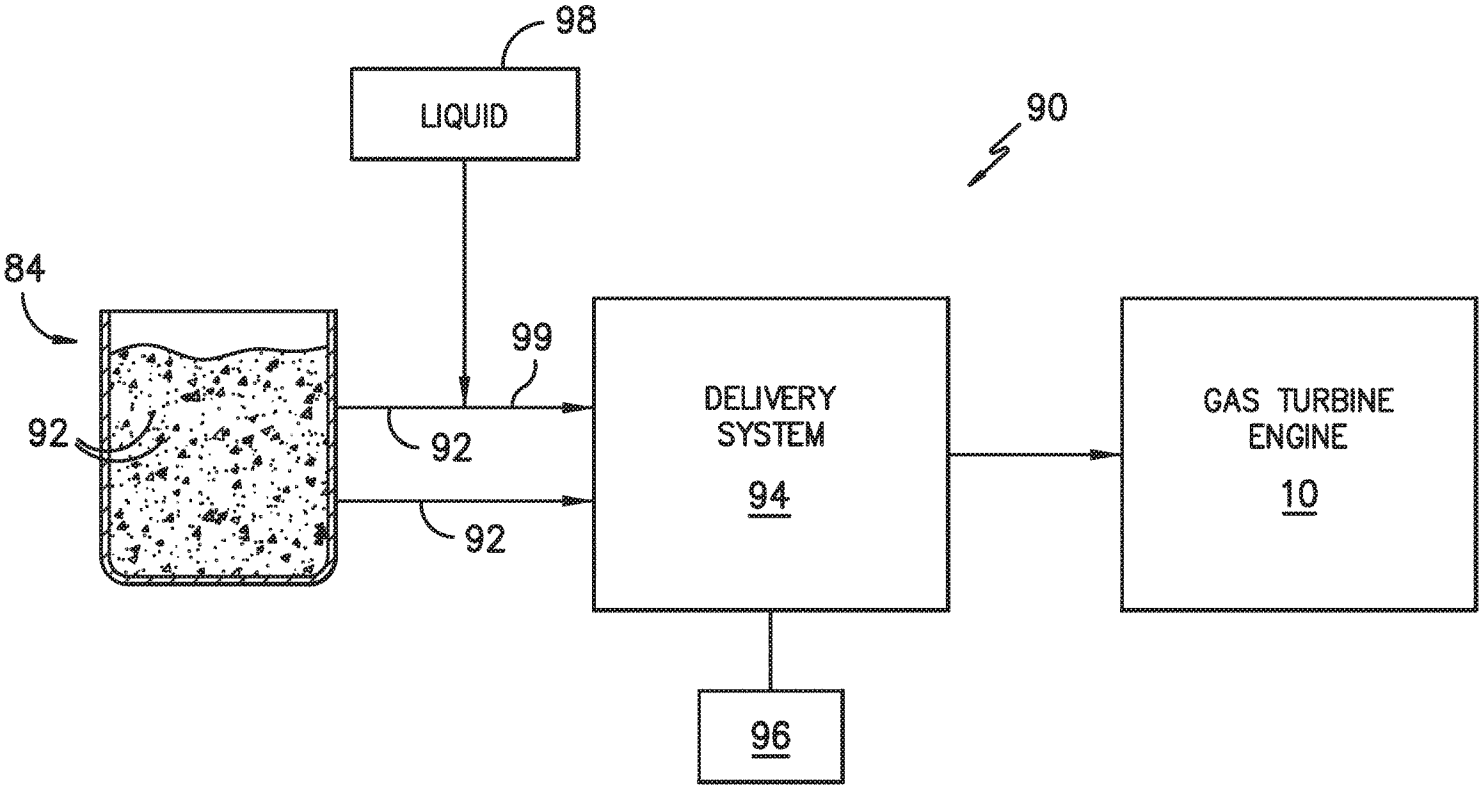
FIG. 4 illustrates a schematic diagram of one embodiment of a cleaning system for cleaning gas turbine engine components according to the present disclosure.

Referring now to FIG. 4, a schematic diagram of one embodiment of a cleaning system 90 for in-situ cleaning of one or more components of a gas turbine engine 10 is illustrated. As shown, the cleaning system 90 includes a cleaning medium 84 containing a plurality of microparticles 92 as described herein. Further, as shown, the cleaning system 90 includes a delivery system 94 configured to deliver the cleaning medium 84 at one or more locations of the gas turbine engine 10 so as to clean the one or more components thereof. More specifically, the delivery system 94 may include any suitable delivery device for delivering the cleaning medium 84, including but not limited to the one or more external pressure sources 96 in fluid communication with the various components of the engine 10 to be cleaned via pipes, hose, conduits, tubing, or similar. Further, the location(s) may include a gas turbine inlet, one or more ports of the gas turbine engine 10, one or more cooling passageways of the gas turbine engine 10, and/or an existing baffle plate. The abrasive cleaning system 90 can also be employed in cooling passages that operate at air pressures of up to 1000 pounds per square inch (psi) in the turbine engine during service. Further, the abrasive medium and delivery system 90 can be employed at pressures from about five (5) psi to about 1000 psi to clean passages. Thus, it is intended that the cleaning medium 84 and delivery system 94 can be employed such that it can be transmitted into the cooling structure of the turbine engine 10 through the outer wall of the engine through ports such as bore scope access ports, fuel nozzle flanges, instrumentation access ports. Further, in certain embodiments, the delivery system 94 may include one or more external pressure sources 96 configured to provide airflow to the engine 10 so as to circulate the abrasive microparticles 92 therethrough. For example, in certain embodiments, the external pressure source(s) 96 may include a fan, a blower, a pump, or any other suitable device.

Thus, as shown, in certain embodiments, the method 100 may also include creating a cleaning mixture 99 by mixing the plurality of abrasive microparticles and a liquid 98, e.g. such as water or water-based detergent. In such embodiments, the step of circulating the cleaning medium 84 through at least a portion of the gas turbine engine 10 may include circulating the cleaning mixture 99 through the gas turbine engine 10 via a pump. As such, for certain components, air can be used for injecting the abrasive particles, e.g. via fan, whereas in other components such as shrouds, combustors, and nozzles, water may be used as the medium for delivery of the abrasive particles.

More specifically, in certain embodiments, cleaning of the engine 10 may be performed by spraying the abrasive media at the component that has a dust layer on it. For example, the abrasive medium may be sprayed through the baffle plate system that is used in the engine for impingement cooling. In another example, the abrasive medium may be sprayed through a borescope injection port while rotating the core of the compressor, so as to impinge upon the compressor airfoils.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for in-situ cleaning one or more components of an aircraft-mounted gas turbine engine, the method comprising:

injecting a dry cleaning medium into the gas turbine engine at one or more locations, the dry cleaning medium comprising a plurality of abrasive microparticles; and circulating, via motoring of the gas turbine engine, the cleaning medium through at least a portion of the gas turbine engine as mounted on an aircraft such that the abrasive microparticles abrade a surface of the one or more components so as to clean the surface.

2. The method of claim 1, wherein the plurality of abrasive microparticles comprises nut shells, fruit pit stones, alumina, silica, diamond, or a combination including any of the foregoing.

3. The method of claim 2, the plurality of abrasive microparticles comprising individual particle diameter sizes ranging from about 10 microns to about 100 microns.

4. The method of claim 1, wherein a first set of the plurality of abrasive microparticles comprises a median particle diameter equal to or less than 20 microns, and wherein a second set of the plurality of abrasive microparticles comprises a median particle diameter equal to or greater than 20 microns.

5. The method of claim 4, wherein the first set of abrasive microparticles comprises a median particle diameter equal to or less than 10 microns, and wherein the second set of abrasive microparticles comprises a median particle diameter equal to or greater than 40 microns.

6. The method of claim 1, wherein injecting the dry cleaning medium into the gas turbine engine further comprises injecting the cleaning medium into an inlet of the gas turbine engine, one or more ports of the gas turbine engine, one or more cooling passageways of the gas turbine engine, an existing baffle plate system of the gas turbine engine, or a combination including any of the foregoing.

7. The method of claim 6, wherein circulating the cleaning medium through at least a portion of the gas turbine engine further comprises motoring the gas turbine engine during injection of the cleaning medium so as to provide airflow that circulates the plurality of abrasive microparticles through the gas turbine engine.

8. The method of claim 6, wherein circulating the cleaning medium through at least a portion of the gas turbine engine further comprises utilizing one or more external pressure sources to provide airflow that circulates the plurality of abrasive microparticles through the gas turbine engine.

9. The method of claim 1, further comprising creating a cleaning mixture comprising the plurality of abrasive microparticles and at least one of water or detergent.

10. The method of claim 9, further comprising circulating the cleaning mixture through at least a portion of the gas turbine engine via a pump.

11. The method of claim 1, wherein the one or more components of the gas turbine engine comprise at least one of a compressor, a high-pressure turbine, a low-pressure turbine, a combustion chamber, a nozzle, one or more blades, a booster, a casing of the gas turbine engine, turbine shrouds, or one or more cooling passageways of the gas turbine engine.

12. The method of claim 1, wherein the dry cleaning medium comprises silica.

13. The method of claim 1, wherein the plurality of abrasive microparticles comprises microparticles from at least one fruit pit stone.

14. The method of claim 13, wherein the plurality of abrasive microparticles comprises microparticles from at least one plum pit stone.

15. The method of claim 1, further comprising injecting the dry cleaning medium at a borescope port.

16. The method of claim 1, further comprising injecting the dry cleaning medium at a fuel nozzle flange.

17. A cleaning system for in-situ cleaning of one or more components of a gas turbine engine, the cleaning system comprising:

a dry cleaning medium comprising a plurality of abrasive microparticles, the plurality of abrasive microparticles comprising individual particle diameter sizes ranging from about 10 microns to about 100 microns; and a delivery system configured to deliver the cleaning medium at one or more locations of the gas turbine engine circulating via motoring of the gas turbine engine so as to clean the one or more components thereof, wherein the gas turbine engine is installed on an aircraft.

18. The cleaning system of claim 17, wherein the delivery system comprises one or more external pressure sources to provide airflow that circulates the plurality of abrasive microparticles through the gas turbine engine.

19. The cleaning system of claim 18, wherein the one or more external pressure sources comprise at least one of a fan, a blower, or a pump, and wherein the one or more external pressure sources provide airflow at a pressure range between 5 psi and 1000 psi.

20. A method for in-situ cleaning one or more components of a gas turbine engine, the method comprising:

injecting a dry cleaning medium into the gas turbine engine at one or more locations, the dry cleaning medium comprising a plurality of abrasive microparticles; and circulating, via motoring of the gas turbine engine, the cleaning medium through at least a portion of the gas turbine engine such that the abrasive microparticles abrade a surface of the one or more components, wherein the dry cleaning medium comprises alumina.

* * * * *